US007812696B2

(12) United States Patent
Hartinger et al.

(10) Patent No.: US 7,812,696 B2
(45) Date of Patent: Oct. 12, 2010

(54) METHOD AND DEVICE FOR SECURELY OPERATING A SWITCHING DEVICE

(75) Inventors: Peter Hartinger, Bodenwöhr (DE); Ludwig Niebler, Laaber (DE); Fritz Pohl, Hemhofen (DE); Norbert Zimmermann, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 547 days.

(21) Appl. No.: 11/793,498

(22) PCT Filed: Dec. 22, 2005

(86) PCT No.: PCT/EP2005/057076

§ 371 (c)(1),
(2), (4) Date: Jun. 21, 2007

(87) PCT Pub. No.: WO2006/069958

PCT Pub. Date: Jul. 6, 2006

(65) Prior Publication Data

US 2008/0094156 A1 Apr. 24, 2008

(30) Foreign Application Priority Data

Dec. 23, 2004 (DE) ..... 10 2004 062 266

(51) Int. Cl.
*H01H 67/02* (2006.01)

(52) U.S. Cl. ..... 335/132

(58) Field of Classification Search ..... 335/8–10, 335/132

See application file for complete search history.

(56) References Cited

U.S. PATENT DOCUMENTS

| | | | | | |
|---|---|---|---|---|---|
| 4,470,028 | A | * | 9/1984 | Vayre et al. | 335/16 |
| 4,473,860 | A | * | 9/1984 | Thomas | 361/139 |
| 4,737,749 | A | | 4/1988 | Held | |
| 5,163,175 | A | * | 11/1992 | Mori et al. | 335/132 |
| 5,243,291 | A | * | 9/1993 | Umemura | 324/418 |
| 5,252,933 | A | * | 10/1993 | Kamino et al. | 335/172 |
| 5,455,733 | A | | 10/1995 | Waggamon | |
| 5,880,658 | A | * | 3/1999 | Donhauser et al. | 335/132 |
| 6,023,110 | A | * | 2/2000 | Henrion et al. | 307/125 |

(Continued)

FOREIGN PATENT DOCUMENTS

| | | |
|---|---|---|
| EP | 0 224 081 | 6/1987 |

(Continued)

*Primary Examiner*—Elvin G Enad
*Assistant Examiner*—Alexander Talpalatskiy
(74) *Attorney, Agent, or Firm*—Harness, Dickey & Pierce, P.L.C.

(57) ABSTRACT

A method and a device for secure operation of a switching device including at least two main contacts which can be switched on and off and include contact pieces and a displaceable contact bridge, and a control magnet having a displaceable anchor. The method may include producing an electric control signal to release a contact breaking device when the control magnets are switched on and off. The emitted control signal lies outside the ON state of the switching contact during the regular operation of the switching device and releasing the contact breaking device in defective operation of the switching device if the switching contact remains in the ON state when the control magnets are switched on or off. The switching contact may connect through the control signal to release the contact breaking device.

22 Claims, 4 Drawing Sheets

U.S. PATENT DOCUMENTS

| | | | | |
|---|---|---|---|---|
| 6,150,909 | A * | 11/2000 | Meier | 335/132 |
| 6,411,184 | B1 * | 6/2002 | Comtois et al. | 335/106 |
| 6,566,618 | B2 * | 5/2003 | Hamada et al. | 200/308 |
| 7,692,522 | B2 * | 4/2010 | Hartinger et al. | 335/131 |
| 2002/0063049 | A1 * | 5/2002 | Hamada et al. | 200/308 |

FOREIGN PATENT DOCUMENTS

| | | |
|---|---|---|
| EP | 0 224 081 B1 | 2/1991 |
| EP | 0 832 496 | 4/1998 |
| EP | 1 002 325 | 2/1999 |
| EP | 0 694 937 B1 | 3/2000 |
| EP | 0 832 496 B1 | 5/2001 |
| EP | 1 298 689 A2 | 4/2003 |

* cited by examiner

METHOD AND DEVICE FOR SECURELY OPERATING A SWITCHING DEVICE

PRIORITY STATEMENT

This application is the national phase under 35 U.S.C. §371 of PCT International Application No. PCT/EP2005/057076 which has an International filing date of Dec. 22, 2005, which designated the United States of America and which claims priority on German Patent Application number 10 2004 062 266.3 filed Dec. 23, 2004, the entire contents of which are hereby incorporated herein by reference.

FIELD

At least one embodiment of the present invention generally relates to a method for safe operation of a switching device, and/or to a corresponding apparatus.

BACKGROUND

Switching devices, in particular low-voltage switching devices, can be used to switch the current paths between an electrical supply device and loads, and therefore to switch their operating currents. Thus, the switching device opens and closes current paths, allowing the connected loads to be safely connected and disconnected.

An electrical low-voltage switching device, such as a contactor, a circuit breaker or a compact starter, has one or more so-called main contacts, which can be controlled by one or else more control magnets, in order to switch the current paths. In principle, in this case, the main contacts include a moving contact link and fixed contact pieces, to which the loads and the supply device are connected. In order to close and open the main contacts, an appropriate connection or disconnection signal is passed to the control magnets, in response to which their armatures act on the moving contact links such that the latter carry out a relative movement with respect to the fixed contact pieces, and either close or open the current paths to be switched.

Appropriately designed contact surfaces are provided in order to improve the contact between the contact pieces and the contact links at points at which the two meet one another. These contact surfaces are composed of materials such as silver alloys, which are applied at these points both to the contact link and to the contact pieces, and have a specific thickness.

The materials of the contact surfaces are subject to wear during every switching process. Factors which can influence this wear are:

- increasing contact erosion or contact wear as the number of connection and disconnection processes increases,
- increasing deformation,
- increasing contact corrosion caused by arcing, or
- environmental influences, such as vapors or suspended particles, etc.

This results in the operating currents no longer being safely switched, which can lead to current interruptions, contact heating or to contact welding.

For example, particularly as the contact erosion increases, the thickness of the materials applied to the contact surfaces will decrease. The switching movement between the contact surfaces of the contact link and the contact pieces therefore becomes longer, thus in the end reducing the contact force on closing. As the number of switching processes increases, this results in the contacts no longer closing correctly. The resultant current interruptions or else the increased connection bouncing can then lead to contact heating and thus to increasing melting of the contact material, which can in turn then lead to welding of the contact surfaces of the main contacts.

If a main contact of the switching device has become worn or even welded, the switching device can no longer safely disconnect the load. In particular in the case of a welded contact, at least the current path with the welded main contact will still continue to carry current and will still be live, despite the disconnection signal, so that the load is not completely isolated from the supply device. Since, in consequence, the load remains in a non-safe state, the switching device represents a potential fault source.

The protective function can thus be blocked, for example, in the case of compact starters according to IEC 60 947-6-2, in which an additional protection mechanism acts on the same main contacts as the control magnet during normal switching.

Fault sources such as these must therefore be avoided for safe operation of switching devices and thus for protection of the load and of the electrical installation.

European Laid-Open Specification EP 1 002 325 A1 discloses a relatively complex method for identification of the remaining electrical life of contacts, in which contact welding during disconnection of the switching device is identified by existing or additional means. The risk resulting from major electrical faults for loads and electrical installations is thus overcome by emitting a message and/or by ceasing switching operation, in particular after short-circuit switching operations.

European Laid-Open Specification EP 0 832 496 A1 discloses a method in which contact welding in the switching device is detected by monitoring the switching device drive. A series-connected second switching device is operated in order to interrupt the circuit when the switching device drive does not reach its normal disconnected position during the disconnection process.

SUMMARY

At least one embodiment of the present invention is to identify at least one of such potential fault sources, and to react appropriately to them.

At least one embodiment of the present invention makes it possible to identify a welded contact during connection and disconnection of the switching device, and then to break open the welded contact, with little complexity.

At least one embodiment of the invention relates to a method and an apparatus for safe operation of a switching device having at least one main contact which can be connected and disconnected and has contact pieces and a moving contact link. The switching device has at least one control magnet with a moving armature, with the armature acting on the contact link during connection and disconnection such that the corresponding main contact is closed and opened. A switching contact is provided, which has an ON state and an OFF state corresponding to a closed position and an open position of the armature.

According to at least one embodiment of the invention, in a first step, an electrical drive signal is produced for initiation of a contact breaking-open device on connection and/or disconnection of the control magnet, with the drive signal being emitted such that it is outside the ON state of the switching contact during normal operation of the switching device. In a second step, in the event of a fault, in particular in the event of at least one main contact of the switching device being welded, the contact breaking-open device is initiated if the switching contact remains or has remained in the ON state on connection or disconnection of the control magnet, in that the switching contact passes on the drive signal in order to initiate the contact breaking-open device.

Alternatively, according to at least one embodiment of the invention, an electrical drive pulse for possible initiation of a contact breaking-open device on connection and/or disconnection of the control magnet is produced in a first step, with the respective time duration of the drive pulse being designed such that it occurs at a time within the OFF state of the switching contact during normal operation of the switching device. In a second step, the contact breaking-open device is initiated in that the switching contact passes on the drive pulse for initiation of the contact breaking-open device if the switching contact remains or has remained in the ON state on connection or disconnection of the control magnet.

In at least one embodiment of the invention, suitable electrical signals are produced which allow the initiation of a contact breaking-open device.

A particular advantage of at least one embodiment of the invention is that the presence of at least one welded main contact in the switching device can be checked for during every switching operation. In the event of a fault, the at least one welded main contact can be broken open by initiation of a contact breaking-open device. Additionally or alternatively, appropriate warning signals can be produced, which indicate that operation of the switching device is not safe.

The method according to at least one embodiment of the invention and the apparatus according to at least one embodiment of the invention therefore ensure safe operation of a multipole switching device, such as a contactor, a circuit breaker or a compact outgoer and, in particular, safe operation of a three-pole switching device.

In particular, in at least one embodiment, the electrical drive pulse is delayed by a predetermined value during disconnection of the switching device. This delay may, for example, be produced by an OFF-delayed break contact.

Alternatively, the electrical drive pulse can also be produced by way of an electronic circuit. At least one pulse generator, such as a monostable multivibrator or a so-called monoflop, and a time delay element can be provided for this purpose in order to produce the time delay for the electrical drive pulse and, if required, for the time delay.

Furthermore, further operation of the switching device can be interrupted once the contact breaking-open device has been initiated. The blocking of normal switching can be indicated and/or processed further by way of a display, by a mechanical indication and reset element, by a signaling contact or via a data bus.

Further advantageous embodiments and preferred developments of the invention are specified in the disclosure and figures below.

BRIEF DESCRIPTION OF THE DRAWINGS

Advantageous embodiments of the invention will be described in more detail in the following text, with reference to the following figures, in which.

DETAILED DESCRIPTION OF THE EXAMPLE EMBODIMENTS

Figure 1:
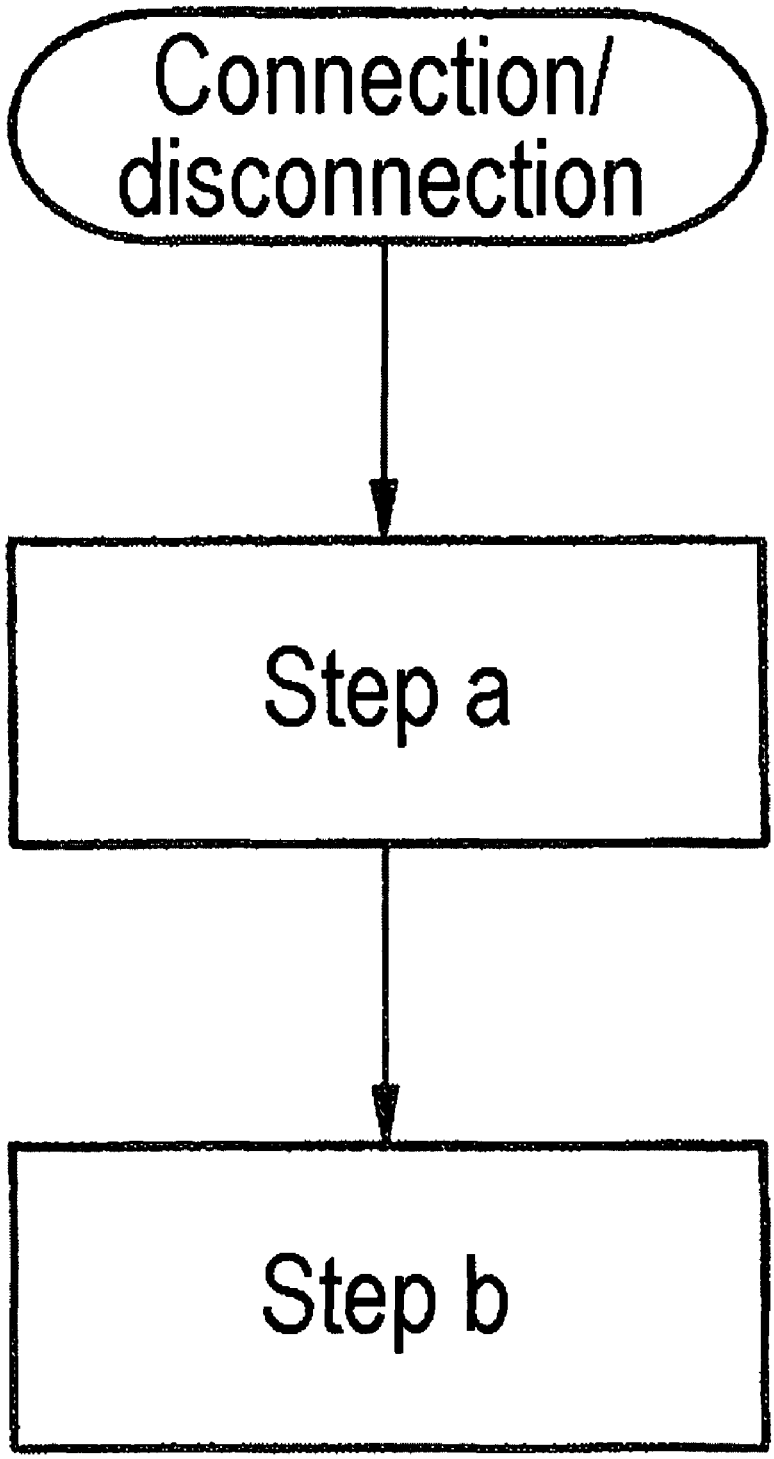
FIG. 1 shows a simplified flowchart of the method according to an embodiment of the invention.

As illustrated in FIG. 1, the following steps are essentially both carried out in the method according to an embodiment of the invention:

step a) production of an electrical drive signal for initiation of a contact breaking-open device on connection and/or disconnection of the control magnet, with the drive signal being emitted such that it is outside the ON state of the switching contact during normal operation of the switching device, and step b) initiation of the contact breaking-open device during faulty operation of the switching device if the switching contact remains or has remained in the ON state on connection or disconnection of the control magnet, in that the switching contact passes on the drive signal in order to initiate the contact breaking-open device.

In the alternative method according to an embodiment of the invention, the following steps are both essentially carried out:

step a) production of an electrical drive pulse for possible initiation of a contact breaking-open device on connection and/or disconnection of the control magnet, with the respective time duration of the drive pulse being designed such that it occurs at a time within the OFF state of the switching contact during normal operation of the switching device, and step b) initiation of the contact breaking-open device, in that the switching contact passes on the drive pulse if the switching contact remains or has remained in the ON state on connection or disconnection of the control magnet.

This ensures that at the end of the life of the switching device, that is to say when the contact materials on the contact surfaces have in particular been worn away to such an extent that at least one main contact has become welded, this welded contact can be broken open, thus ensuring safe operation of the switching device.

The method according to an embodiment of the invention is used for switching devices whose normal switching is carried out by controllable drives, such as remotely operated switches, contactors or circuit breakers.

The initiation process unlocks a force energy store, such as a latching mechanism, by which the welded contacts are broken open. Furthermore, an electrically operated force element may be provided in order to break open the welded contacts. In order to disconnect the current flow to the load in the event of strong contact welding which cannot be broken open by the latching mechanism, the latching mechanism can operate a further contact opening mechanism which allows the switching contacts to be opened independently of one another. This results in the contacts that are not welded being opened by the latching mechanism, and in the current flow being interrupted.

The pulse delay and the drive pulse can be provided in a known manner by mechanical, electromechanical or electronic devices/methods, and the electrical energy that is required can be provided by an electrical energy store, for example by way of a capacitor or a coil. The control voltage for the circuit breaker can be used for electrical charging of the energy store.

The apparatus according to an embodiment of the invention will be described in more detail in the following text with reference, by way of example, to two example embodiments.

Figure 2:
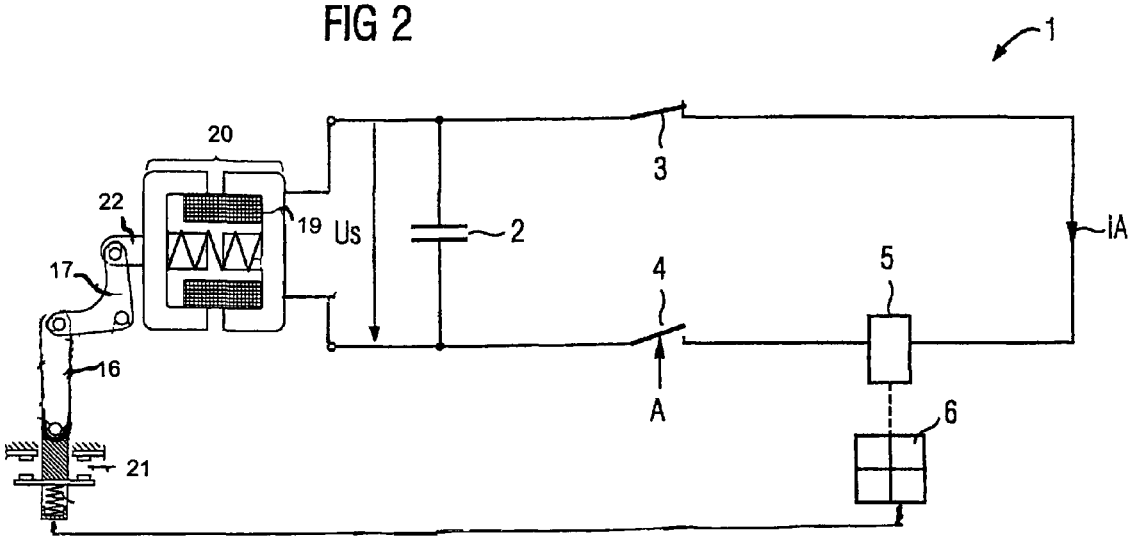
FIG. 2 shows a first embodiment of the apparatus according to an embodiment of the invention.

For example, FIG. 2 shows a first embodiment of the apparatus 1 according to the invention. The apparatus 1 is electrically supplied with a switching voltage Us via two terminals, which are shown in the left-hand part of FIG. 2. The switching voltage Us is normally applied to a control magnet 20 or to an electromagnetic drive for the switching device when a connection command occurs for the control device. When the switching voltage is applied, a field coil 19 for the control magnet 20 is supplied with current, so that an armature 22 of the control magnet 20 can operate the main contacts 21 of the switching device, in order to open and close them. The switching device may include the at least one connectable/disconnectable main contact 21, a moving contact link 16, 17, at least one control magnet 20 with a moving armature 22 to act on the contact link 16, 17 during connection and disconnection to close and open the corresponding main contact 21, and a switching contact including an ON state and an OFF state corresponding to a closed position and an open position of the armature, the apparatus. A capacitance 2, in the form of a capacitor for energy storage, is shown in parallel with the switching voltage Us. This energy is available in particular during disconnection of the switching device, that is to say after removal of the switching voltage Us, in order to initiate a contact breaking-open device.

The example in FIG. 2 shows an initiation unit 5 which is mechanically operatively connected to a latching mechanism 6 as a contact breaking-open device for breaking open a welded main contact. In order to initiate the latching mechanism 6, the initiation unit 5 requires an electric current iA, which must be applied to the initiation unit 5 for a certain minimum time.

In the example in FIG. 2, this is possible only when both of the switching contacts 3 and 4, which are connected in series with the initiation unit 5, are closed. The electrical contact 3 is a break contact. The electrical contact 4 is a make contact corresponding essentially to the closed and open position of the armature in its ON state and OFF state. The break contact 3 may, for example, be an OFF-delayed relay contact, with the coil of the relay contact preferably being connected to the buffered switching voltage Us.

During connection of the electromagnetic drive or of the control magnet for the switching device, the armature moves in the closing direction, provided that the contacts are not welded, once the magnetic force has increased above the level of the force difference including the spring opening force of the armature and the contact load on the moving contacts. After a closing movement of a few millimeters, for example 4 mm, the moving contacts, which are coupled to the armature via mechanical operating elements, strike the fixed contacts of the switching device. The pressure required for a secure contact force on the switching contacts is built up by the further closing movement of the armature. The overall armature movement from the start of armature movement to the connected position may, for example, be 6 mm. A typical closing time of 10 to 30 milliseconds with a closing speed of between 0.5 and 2 m/s is achieved in the case of switching devices, such as contactors, during the accelerated closing movement of the armature from the disconnected position to the connected position.

During this process, the majority of the closing time is taken up by the movement from the disconnected position of the moving contacts to the point at which they touch the fixed contacts. The operation of the electrical contact 4 is linked to the movement of the armature, with the electrical contact 4 being open in the armature open position and being closed at a specific armature position during the armature closing movement. This armature position is defined such that this contact 4 will undoubtedly be closed in the event of contact welding and when the control magnet is disconnected.

According to an embodiment of the invention, an electrical drive signal is now emitted in order to initiate the contact breaking-open device 6. This is achieved by the electrical break contact 3 being opened on or shortly after the presence of the connection command, that is to say on the application of the switching voltage Us, before the electrical make contact 4 closes on reaching the switch position of the armature in the area of the contact touching point, during normal switching operation.

On disconnection of the control magnet, the magnetic field is first of all dissipated before the start of the armature opening movement, until the magnetic armature closing force becomes weaker than the armature opening force. After an opening movement of a few millimeters, the armature or the contact slide which is connected with a force fit to it strikes the moving contacts of the switching device, and opens them, provided that the main contacts are not welded. The make contact 4, which is operated by the armature movement, opens its contact at the predetermined position of the armature, and remains in the disconnected state during the rest of the armature opening movement. The time period from the disconnection command for the switching device to safe disconnection of the make contact 4 governs the minimum duration for the predetermined delay time of the drive signal for driving the initiation unit 5.

During normal operation, the drive signal is thus deactivated before or at the end of the delay time during disconnection by way of the make contact 4, and is maintained until the next connection command. During disconnection of the switching device, that is to say on removal of the switching voltage Us, the break contact 3 moves back with the predetermined delay time, such as 100 ms, once the make contact has already been opened again, during normal switching operation. The alternate OFF position of the switching contacts 3 and 4 during normal switching operation means that no current iA can flow to the initiation unit 5 in order to initiate the contact breaking-open device 6.

According to an embodiment of the invention, during faulty operation of the switching device, the contact breaking-open device 6 is now initiated if the switching contact 4 remains or has remained in the ON state on connection or disconnection of the control magnet. This then passes on the drive signal in order to initiate the contact breaking-open means 6, by supplying current iA to the initiation unit 5. The drive signal can in this case be regarded as an enable signal, which is applied to the initiation unit 5 during connection and in the event of a break contact 3 already being closed, in the form of the switching voltage Us and is applied to the initiation unit 5 during disconnection and after the break contact 3 "remains closed" in the form of the buffered switching voltage Us.

Contact welding is thus reliably identified during disconnection of the switching device, and the latching mechanism 6 is unlatched by the initiation unit 5. When the welded contacts are broken open, the circuit to the load is disconnected, and the switching device is inhibited from further normal switching.

The switching device can be used again only after the welded contacts have been broken open or new contacts have been fitted. Current can therefore no longer flow via the switching contacts. If a number of such connection attempts are made, the latching mechanism carries out the same number of additional attempts to break open the welded contacts, by which it is generally possible to overcome medium-strength welded contacts.

The make contact 4 connects or disconnects the field circuit for the initiation unit, and may also be in an electronic form, switchable by sensor control. The make contact 4 may, for example, be a reed relay, which is made to close and open by a permanent magnet fitted to the armature. The make contact 4 may also be a positively guided mechanical switching element which is operated by the armature or by a mechanical component coupled to it. A mechanical circuit, an electromechanical circuit or an electronic circuit is used to derive a time-delayed drive signal from the disconnection command for the control magnet for the initiation unit 5, which drive signal is fed through the electrical energy store and, if contacts are welded, operates the initiation unit 5 and unlatches the latching mechanism 6 of the switching device. This is described in detail in the next figure, FIG. 3.

Figure 3:
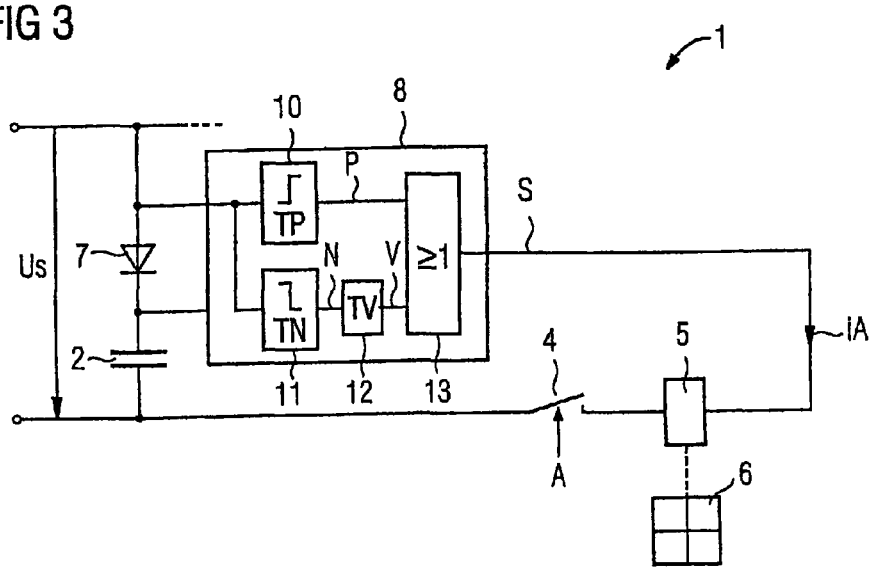
FIG. 3 shows a second embodiment of the apparatus according to an embodiment of the invention.

FIG. 3 shows an example of a second embodiment of the apparatus 1. The function of the switching contact 3 is now carried out by an electronic circuit or by control electronics 8, which produces or produce suitable drive pulses PL in a sum signal S at the output of the circuit 8. In the example shown in FIG. 3, the sum signal S is generated by way of an OR element 13, which combines the two individual signals P and V.

The signal P is produced by way of a monostable multivibrator 10 or a monoflop 10 as a pulse generator, which reacts to a positive-edge-triggered input signal. In the present case, the input signal is the switching voltage Us. Thus, during connection of the switching device, the monoflop 10 generates a square-wave pulse with a predetermined time duration TP, which is then present in the sum signal S as a drive pulse PL. The time duration TP is therefore designed such that the drive pulse PL has already "passed" before the make contact 4 closes during normal switching operation. On the other hand, the drive pulse TP must be present for a minimum time so that the downstream initiation unit 5 can still be initiated. The initiation mechanism may, for example, be in an electromagnetic, pyrotechnic or motor form. The time duration TP is, for example, in the region of a few milliseconds.

The signal V is delayed by way of a time delay element 12 by a time period TV of a few milliseconds with respect to a signal N. The signal N is in this case generated by way of a further monostable multivibrator 11 or a further monoflop 11, which reacts to a negative-edge-triggered input signal. In the present case, the input signal is once again the switching voltage Us. Thus, during disconnection of the switching device or when there is no switching voltage Us, the monoflop 11 generates a square-wave pulse with a predetermined time duration TN, which is then present in the sum signal S as the drive pulse PL, delayed by the time period TV. The time duration TN is designed such that the drive pulse PL is sufficiently long to still cause the initiation unit 5 to be initiated and is delayed by a time period TV such that the make contact 4 has closed again during normal switching operation.

The time period TP is therefore in the region of a few milliseconds. A series circuit including a diode 7 and an energy storage capacitor 2, and connected in parallel with the terminals, is illustrated in the left-hand part of the monitoring apparatus 1. The diode 7 is used for decoupling the voltage across the capacitor 2 from the switching voltage Us, so that the electronic circuit 8 can still be supplied with current in order to generate the drive pulses PL when there is no switching voltage Us.

Figure 4:
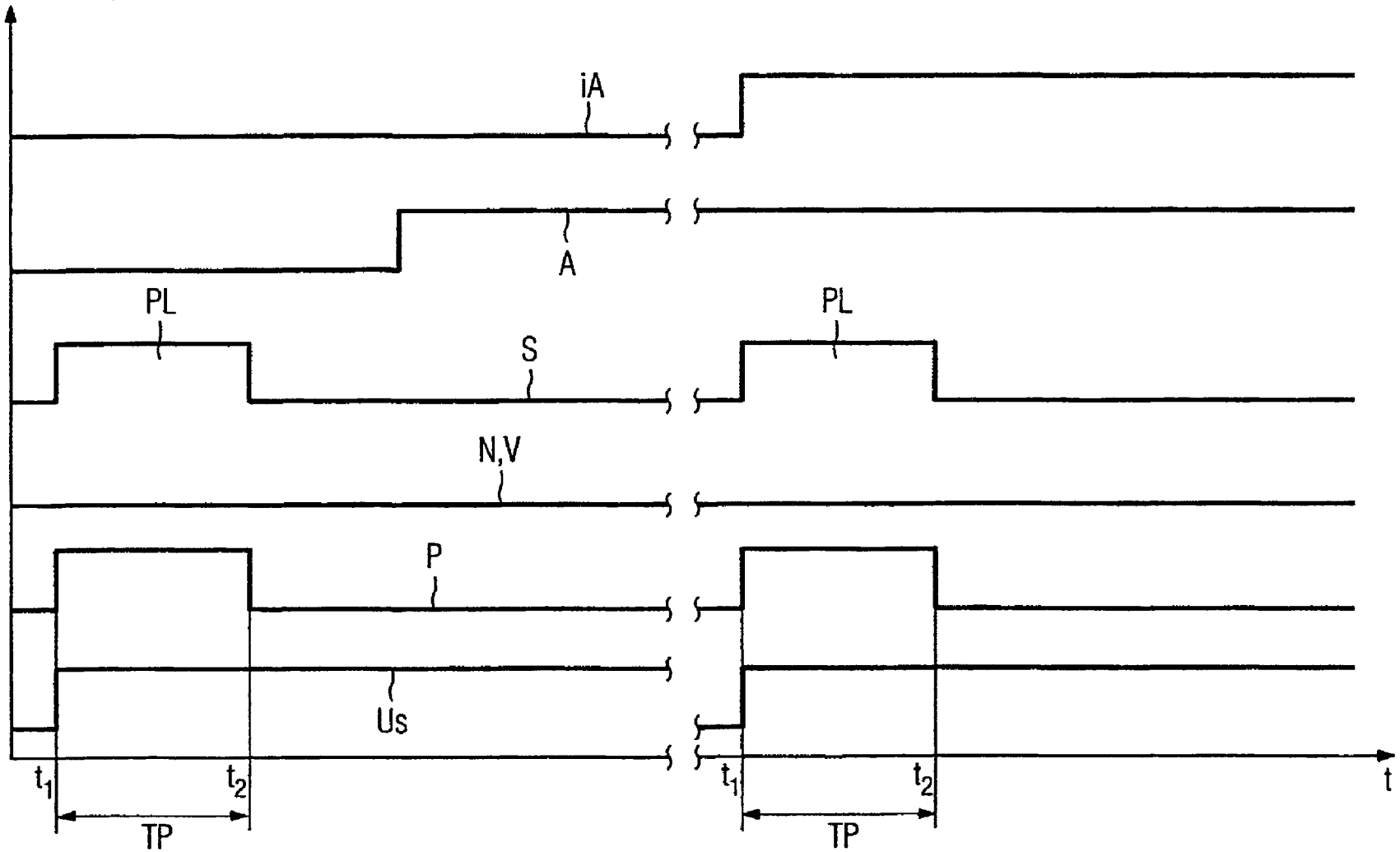
FIG. 4 shows a timing diagram illustrating the time profile of the drive pulse that is produced during connection of the switching device during normal operation and during faulty operation.
Figure 5:
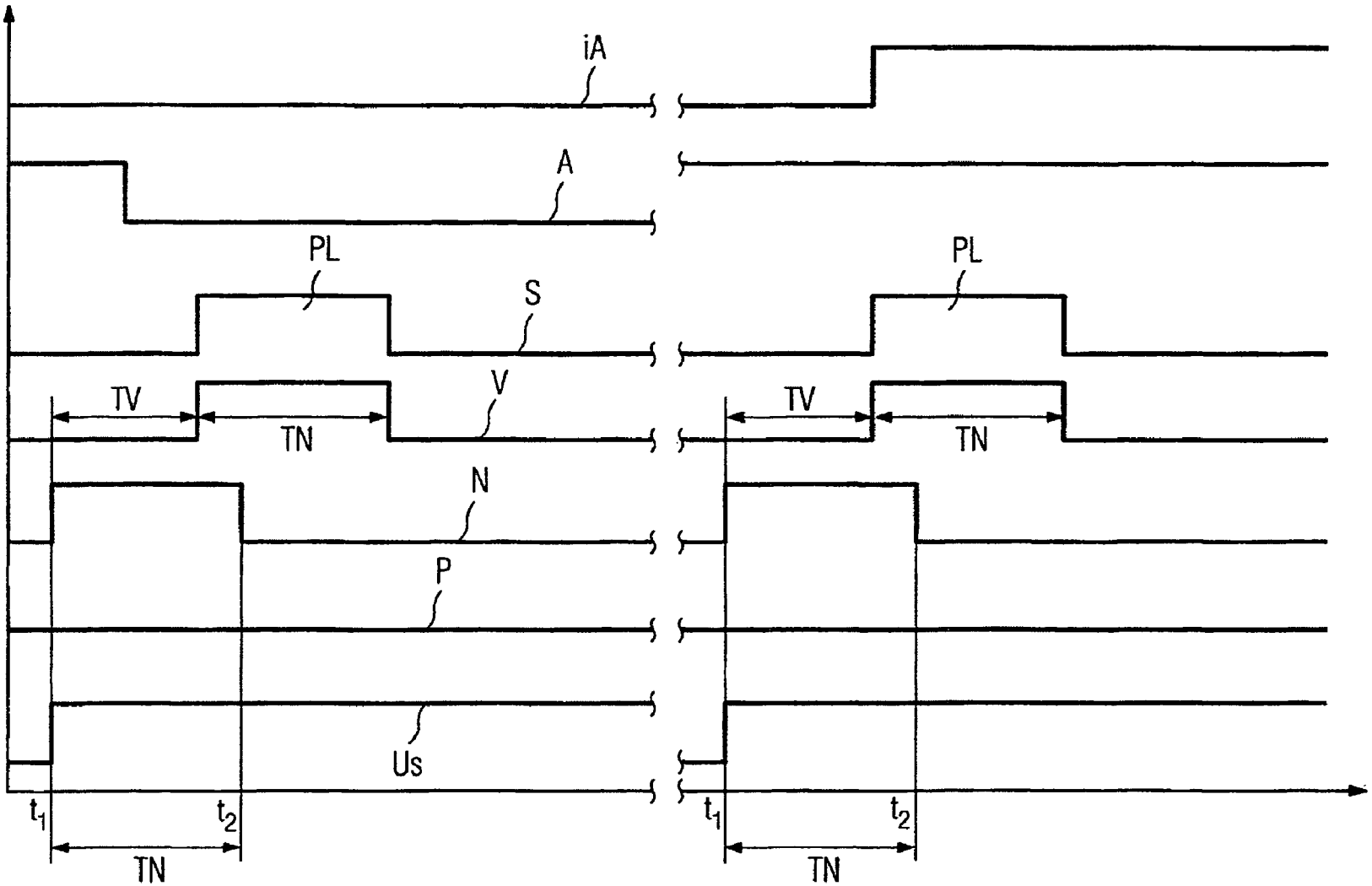
FIG. 5 shows a timing diagram illustrating the time profile of the drive pulse that is produced during disconnection of the switching device during normal operation and during faulty operation.

FIG. 4 shows a timing diagram, illustrating the time profile of the drive pulse PL that is generated during connection of the switching device. FIG. 5 shows the same timing diagram during disconnection of the switching device. The switching response of the switching device during normal operation is in each case shown in the left-hand part of FIG. 4 and FIG. 5, and the switching response of the switching device during faulty operation, that is to say in particular when at least one main contact is welded, is shown in the right-hand part of FIG. 4 and FIG. 5.

FIG. 4 shows the drive pulse PL which is in each case generated during connection of the switching device, essentially from the switching voltage Us without any delay and with the pulse width TP. As is also shown in FIG. 4, this drive pulse PL occurs at a time before the switching edge of the closing switching contact 4 during normal switching operation. This shows the time profile of the armature drive signal A which acts on the switching contact 4. In contrast, the right-hand part of FIG. 4 shows the situation in which welding has occurred, in which the switching contact 4 has no longer opened. In this case, when the drive pulse PL is emitted, a current iA can flow in order to initiate the initiation unit 5.

FIG. 5 shows the drive pulse PL which is generated during disconnection of the switching device, by a time period TV, from the buffered switching voltage Us, with the pulse width TN. As FIG. 5 also shows, this drive pulse PL occurs at a time after the switching edge of the opening switching contact 4 during normal switching operation. This shows the time profile of the armature drive signal A, which acts on the switching contact 4. In contrast, the right-hand part of FIG. 5 shows the situation in which welding has occurred, in which the switching contact 4 has no longer opened. In this case, when the drive pulse PL is emitted, a current iA can flow in order to initiate the initiation unit 5.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A method for safe operation of a switching device including at least one connectable/disconnectable main contact, a moving contact link, at least one control magnet with a moving armature to act on the contact link during connection and disconnection to close and open the corresponding main contact, and a first switching contact including an ON state and an OFF state corresponding to a closed position and an open position of the armature, the method comprising:

producing an electrical drive signal via a second switching contact to initiate a contact breaking-open device, connected in series with the first switching contact and the second switching contact, on at least one of connection and disconnection of the at least one control magnet, the second switching contact not turning on during normal operation of the first switching device; and initiating the contact breaking-open device during faulty operation of the switching device upon the first switching contact remaining in the ON state on connection or disconnection of the control magnet, the first switching contact and the second switching contact passing on the drive signal to initiate the contact breaking-open device.

2. The method as claimed in claim 1, wherein producing the electrical drive signal includes producing the signal by way of an OFF-delayed break contact.

3. A method for safe operation of a switching device including at least one connectable/disconnectable main contact, a moving contact link, at least one control magnet with a moving armature to act on the contact link during connection and disconnection to close and open the corresponding main contact, and a first switching contact including an ON state and an OFF state corresponding to a closed position and an open position of the armature, the method comprising:

producing an electrical drive pulse via a second switching contact to initiate a contact breaking-open device, connected in series with the first switching contact and the second switching contact, on at least one of connection and disconnection of the at least one control magnet, with respective time duration of the drive pulse occurring within the OFF state of the second switching contact during normal operation of the first switching device; and initiating the contact breaking-open device, the first switching contact and the second switching contact passing on the drive pulse upon the first switching contact remaining in the ON state on connection or disconnection of the control magnet.

4. The method as claimed in claim 3, further comprising delaying the electrical drive pulse by a value during disconnection of the switching device.

5. The method as claimed in claim 1, wherein producing the at least one of the electrical drive signal and the electrical drive pulse includes producing the at least one of the electrical drive signal and the electrical drive pulse by an electronic circuit.

6. The method as claimed in claim 5, wherein producing the at least one of the electrical drive signal and the electrical drive pulse includes producing the at least one of the electrical drive signal and the electrical drive pulse via at least one monostable multivibrator and a time delay element in the electronic circuit.

7. The method as claimed in claim 1, further comprising interrupting further operation of the switching device once the contact breaking-open device has been initiated.

8. An apparatus for safe operation of a switching device including at least one connectable/disconnectable main contact, a moving contact link, at least one control magnet with a moving armature to act on the contact link during connection and disconnection to close and open the corresponding main contact, and a first switching contact including an ON state and an OFF state corresponding to a closed position and an open position of the armature, the apparatus comprising:

a second switching contact that initiates a contact breaking-open device on at least one of connection and disconnection of the control magnet and the second switching contact does not turn on during normal operation of the first switching device; and an initiating device, connected in series with the first switching contact and the second switching contact, that initiates the contact breaking-open device during faulty operation of the switching device, upon the first switching contact remaining in the ON state on connection or disconnection of the control magnet, the first switching contact and the second switching contact passing on the drive signal to initiate the contact breaking-open device.

9. The apparatus as claimed in claim 8, further comprising an OFF-delayed break contact configured to produce the electrical drive signal.

10. An apparatus for safe operation of a switching device including at least one connectable/disconnectable main contact, a moving contact link, at least one control magnet including a moving armature to act on the contact link during connection and disconnection to open and close the corresponding main contact, and a switching contact including an ON state and an OFF state corresponding to a closed position and an open position of the armature, the apparatus comprising:

an electrical drive pulse producing device configured to initiate a contact breaking-open device on at least one of connection and disconnection of the control magnet, a respective time duration of the drive pulse occurring at a time within the OFF state of the switching contact during normal operation of the switching device; and an initiating device, connected in series with the switching contact and the electrical drive pulse producing device, configured to initiate the contact breaking-open device, the switching contact passing on the drive pulse upon the switching contact remaining in the ON state on connection or disconnection of the control magnet.

11. The apparatus as claimed in claim 10, wherein the electrical drive pulse is delayable by a value during disconnection of the switching device.

12. The apparatus as claimed in claim 8, further comprising an electronic circuit configured to produce at least one of the electrical drive signal and the electrical drive pulse.

13. The apparatus as claimed in claim 12, further comprising at least one monostable multivibrator and a time delayed element configured to produce the at least one of the electrical drive signal and the electrical drive pulse in the electronic circuit.

14. The apparatus as claimed in claim 8, wherein further operation of the switching device is interruptible once the contact breaking-open device has been initiated.

15. A switching device to carry out the method as claimed in claim 1 for safe switching of loads, the switching device being at least one of a contactor, a circuit breaker and a compact outgoer.

16. A switching device for safe switching of loads having an apparatus as claimed in claim 8, the switching device being at least one of a contactor, a circuit breaker and a compact outgoer.

17. The switching device as claimed in claim 15, wherein the switching device is a three-pole switching device having three main contacts for connection and disconnection of three current paths with a control magnet.

18. The method as claimed in claim 3, wherein at least one of the electrical drive signal and the electrical drive pulse is produced by an electronic circuit.

19. The method as claimed in claim 18, further comprising at least one monostable multivibrator and a time delay element configured to produce the at least one of the electrical drive signal and the electrical drive pulse in the electronic circuit.

20. The method as claimed in claim 3, wherein further operation of the switching device is interrupted once the contact breaking-open device has been initiated.

21. The apparatus as claimed in claim 10, further comprising an electronic circuit configured to produce at least one of the electrical drive signal and the electrical drive pulse.

22. The apparatus as claimed in claim 10, wherein further operation of the switching device is interruptible once the contact breaking-open device has been initiated.

* * * * *